US006569255B2

(12) United States Patent
Sivacoe

(10) Patent No.: US 6,569,255 B2
(45) Date of Patent: May 27, 2003

(54) PIG AND METHOD FOR CLEANING TUBES

(75) Inventor: Orlande Sivacoe, Red Deer (CA)

(73) Assignee: On Stream Technologies Inc., Calgary (CA)

( * ) Notice: Subject to any disclaimer, the term of this patent is extended or adjusted under 35 U.S.C. 154(b) by 84 days.

(21) Appl. No.: 09/160,235

(22) Filed: Sep. 24, 1998

(65) Prior Publication Data

US 2001/0047811 A1 Dec. 6, 2001

(51) Int. Cl.[7] ..... B08B 9/04
(52) U.S. Cl. ..... 134/8; 134/22.11; 15/104.061
(58) Field of Search ..... 134/8, 22.11, 22.12, 134/104.061

(56) References Cited

U.S. PATENT DOCUMENTS

| | | | | |
|---|---|---|---|---|
| 864,544 | A | 8/1907 | Kessler | |
| 1,547,440 | A | 7/1925 | Penn | |
| 1,597,850 | A | 8/1926 | Weis | |
| 1,668,438 | A | 5/1928 | Weis | |
| 1,673,890 | A | 6/1928 | Smith | |
| 1,683,429 | A | 9/1928 | Walker | |
| 1,713,895 | A | 5/1929 | Ford | |
| 1,795,348 | A | 3/1931 | Schmidt | 165/95 |
| 2,170,997 | A | 8/1939 | Griffin | 15/104.06 |
| 3,425,083 | A | 2/1969 | Wennerberg et al. | |
| 3,460,180 | A | 8/1969 | Girard | |
| 3,474,479 | A | 10/1969 | Girard | |
| 3,939,519 | A | 2/1976 | Muirhead | 15/104.06 R |
| 4,077,079 | A | 3/1978 | Knapp | 15/104.06 |
| 4,079,782 | A | 3/1978 | Soderberg | 165/95 |

(List continued on next page.)

FOREIGN PATENT DOCUMENTS

| | | | |
|---|---|---|---|
| AU | A-57790/90 | 6/1990 | B08B/9/04 |
| CA | 1147106 | 5/1983 | B08B/1/00 |
| CA | 1290110 | 10/1991 | B08B/9/02 |
| CA | 2087122 | 1/1993 | B08B/9/02 |
| EP | 0234072 A1 | 2/1986 | B08B/9/04 |

(List continued on next page.)

OTHER PUBLICATIONS

Abstract of US. Patent 5,186,815, issued Feb. 16, 1993, 2 pages.

Declaration of Shiuchi Wada, Oct. 15, 1996.

Decarbonization, PEC, System, Oct. 1984.

PEC–PIG Decoking System For Your B–2 Furnace/ EXXON, PEC International (USA), Inc., Jan. 15, 1998.

Proposal For PIG Decoking/Furnace PV–F–01, PEC International (USA), Inc., Mar. 6, 1990.

Decarbonization, PEC International (USA) Inc. product brochure, 7 pages.

(List continued on next page.)

*Primary Examiner*—Randy Gulakowski
*Assistant Examiner*—Saeed Chaudhry
(74) *Attorney, Agent, or Firm*—Christensen O'Connor Johnson Kindness PLLC

(57) ABSTRACT

A method of cleaning tubing in an operating heater, in which the tubing has an inlet and an outlet. While the heater is in operation, a hollow, metallic and/or tubular mesh pig is run through the tubing from the inlet to the outlet. Cleaning should be done before contaminant has hardened. An improved pipe pig, preferably hollow, metallic and/or made from tubular mesh, has scraping edges made from longitudinal edges of a wire. The tubular mesh may be a knit, weave or may be knotted. The pig is preferably radially expandable up to twice its fully compressed radius, and may have an expander to force it radially outward. The pipe pig is preferably made of a resilient wire having a polygonal cross-section.

16 Claims, 14 Drawing Sheets

U.S. PATENT DOCUMENTS

| | | | | |
|---|---|---|---|---|
| 4,124,065 | A | * 11/1978 | Leitner et al. | 134/8 X |
| 4,244,072 | A | * 1/1981 | Dunham et al. | 134/8 X |
| 4,283,807 | A | 8/1981 | Bizard | 15/3.51 |
| 4,297,147 | A | 10/1981 | Nunciato et al. | |
| 4,350,202 | A | 9/1982 | Schulz et al. | 165/95 |
| 4,353,414 | A | * 10/1982 | Leitner | 134/8 X |
| 4,383,346 | A | 5/1983 | Bochinski et al. | 15/104.06 |
| 4,390,058 | A | 6/1983 | Otake et al. | 165/1 |
| 4,406,031 | A | 9/1983 | Eimer et al. | 15/104 |
| 4,420,038 | A | 12/1983 | Okouchi et al. | |
| 4,435,872 | A | 3/1984 | Leikam | |
| 4,476,917 | A | 10/1984 | Otake et al. | 165/1 |
| 4,538,316 | A | 9/1985 | Reinhart et al. | |
| 4,556,102 | A | 12/1985 | Bochinski et al. | 165/95 |
| 4,566,533 | A | 1/1986 | Bochinski et al. | 165/95 |
| 4,709,719 | A | 12/1987 | Littleton et al. | 137/168 |
| 4,830,099 | A | 5/1989 | Eimer | 165/95 |
| 5,010,950 | A | 4/1991 | Voith | 165/95 |
| 5,153,963 | A | 10/1992 | Saxon et al. | 15/104.061 |
| 5,176,199 | A | 1/1993 | Czolkoss | 165/1 |
| 5,186,815 | A | 2/1993 | Lenglet | 208/48 |
| 5,213,623 | A | 5/1993 | Burtner | 134/8 |
| 5,358,573 | A | 10/1994 | Sivacoe | 134/8 |
| 5,379,475 | A | 1/1995 | Sivacoe | 15/104.061 |
| 5,431,545 | A | 7/1995 | Knight et al. | 417/248 |
| 5,473,787 | A | 12/1995 | Echols | 15/104.061 |
| 5,592,990 | A | 1/1997 | Ben-Dosa | 165/95 |
| 5,607,513 | A | 3/1997 | Sims | 134/8 |
| 5,630,471 | A | 5/1997 | Taprogge | 165/95 |
| 5,647,428 | A | 7/1997 | Echols | 165/95 |
| 5,685,041 | A | 11/1997 | Sivacoe | |
| 5,882,428 | A | 3/1999 | Gawne | |
| 6,079,074 | A | 6/2000 | Ellett | |
| 6,409,843 | B1 | 6/2002 | Ellett | |

FOREIGN PATENT DOCUMENTS

| | | | |
|---|---|---|---|
| EP | 0 371 859 A1 | 6/1990 | |
| EP | 0 646 423 A1 | 4/1995 | |
| FR | 643 717 A | 9/1928 | |
| FR | 643.717 | 9/1928 | |
| FR | 1.089.182 | 9/1954 | |
| FR | 1 089 182 | 9/1954 | |
| FR | 1.289.600 | 2/1962 | |
| FR | 1 289 600 A | 2/1962 | |
| FR | 75 20129 | 6/1975 | |
| GB | 4730/55 | 7/1957 | |
| GB | 845338 | 10/1958 | |
| GB | 893801 | 7/1960 | |
| GB | 844116 | 8/1960 | |
| GB | 1423132 | 12/1971 | B08A/9/04 |
| GB | 2175666 A | 5/1986 | F28G/1/12 |
| JP | 57-14192 | 1/1982 | |
| JP | 58-78098 | 5/1983 | |
| JP | 58-184500 | 10/1983 | |
| JP | 59-215599 | 12/1984 | |
| WO | WO 91/17843 | 11/1991 | |

OTHER PUBLICATIONS

Finding the basic design for your application, Herbert L. Berman, Caltex Petroleum Corp., Chemical Engineering Jun. 19, 1978, p. 99–170.

UCISCO, A Linde Service Company, brochure entitled "Sandjet Furnace Tube Cleaning—An Energy Conservation Tool", Gary E. Diehl, Union Carbide Industrial Services, Houston, Texas, presented at Phillips Energy Conservation Seminar, Bartlesville, Oklahoma, Apr. 14, 1982, 7 pages.

Computer Search dated Feb. 9, 1997, 4 pages, "decok".

Abstract of U.S. Patent 4,917,787, issued Apr. 17, 1990, 2 pages.

Abstract of U.S. Patent 5,183,642, issued Feb. 2, 1993, 2 pages.

Information sheet on CHORE BOYtm scouring puff, referencing sale of a product in Canada prior to filing of the instant application.

"The Art of Pigging," Girard Industries, n.d., <http://girardind.com/art.htm>.

"Enduro Pipeline Services, Tulsa, OK," Pipeline Automation Systems, Inc., n.d., <http://bright.net/~pasngas/enduro.htm>.

"Oil & Gas Pipeline Products," Maloney Technical Products, n.d., <http://www.maloneytech.com/maloney/pipeline/cupdisc.html>.

* cited by examiner

PIG AND METHOD FOR CLEANING TUBES

FIELD OF THE INVENTION

This invention relates to processes and apparatus used for cleaning tubes, particularly tubes of a heater.

BACKGROUND OF THE INVENTION

Heaters are used in petrochemical installations to heat fluids for a variety of purposes, typically to break apart larger hydrocarbon molecules into smaller molecules. The heaters contain tubes, up to and even more than a kilometer long in each of several passes, that pass first through a convection section of a heater and then through a radiant section. During use, the heater tubes gradually become contaminated on their insides. This contamination, typically coke, tends to degrade the efficiency of the heater over time and can eventually cause the heater to stop working.

Various methods are known for decoking heaters. In one method, the heater is shut down and steam cleaned with high pressure steam. In another method, described for example in U.S. Pat. No. 5,358,573 issued Oct. 25, 1994, by the same inventor, the heater is shut down and pigs with appendages run through the heater until it is clean. In another method, described in U.S. Pat. No. 5,186,815 issued Feb. 16, 1993, the heater tubes are treated while the heater is in operation by injecting solid particles of very small size into the heater tubes, recovering the solid particles at the outlet and recirculating the solid particles back to the inlet of the heater.

Use of pigs to clean heater tubes is very effective since the pigs have a robust scraping action. Heater operators in South America who have used the inventor's method described in U.S. Pat. No. 5,358,573 have asked the inventor to provide cleaning of the heater tubes by pigs while the heater is in operation. Since in many heater tubes temperatures are far higher than conventional polymer pigs will withstand, the inventor has identified a need for a new pig for cleaning an operating heater, and a method for its use. The inventor has thus come up with a novel solution to the problem of providing a heater cleaning operation by using pigs while a heater is in operation.

SUMMARY OF THE INVENTION

It is an object of this invention to provide a novel pig and process for pigging tubes, as for example tubes of a heater, even while it is operating.

There is therefore provided in accordance with an aspect of the invention, an improved pig made from a body, preferably hollow, circular at least in one cross-section to fit within a tube, with scraping edges on the outer periphery of the body. Preferably, the scraping edges are the longitudinal edges of a wire. The wire may be in the form of a tubular mesh, which may be knitted or woven or knotted. The pig is preferably radially expandable up to twice its fully compressed radius, and may have an expander to force it radially outward. The pig is preferably made of a resilient wire having a polygonal cross-section. The pig is preferably entirely made of metal.

Such a pig is capable of cleaning operating heaters without immediate degradation, and is capable of cleaning operating heaters having variably sized tubes.

According to an aspect of a method of the invention, there is provided a method of cleaning tubing comprising the step of running a pig having a scraping action through the tubing, wherein the scraping action is caused by scraping edges on the outer periphery of the pig.

According to further aspects of the method of the invention, the pig has one or more of these characteristics: hollow, metallic, formed of a tubular mesh, and having scraping action caused by edges, preferably longitudinal edges, of a wire.

According to a further aspect of the method of the invention, the heater is cleaned while it is operating.

According to a further aspect of the method of the invention, the pig is run through the tubing repeatedly.

According to a further aspect of the method of the invention, the pig is run through the tubing after contaminant has formed on the inside of the tubing but before the contaminant has hardened.

According to a further aspect of the method of the invention, the tubing is first thoroughly cleaned by a pig, as for example a polymer pig with embedded metallic scraping elements, with a robust scraping action.

In one aspect of the method of the invention, as the pipe pig progresses from smaller to larger tubes, the pig radially expands within the tube, while maintaining 360° C. cleaning coverage of the tube.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
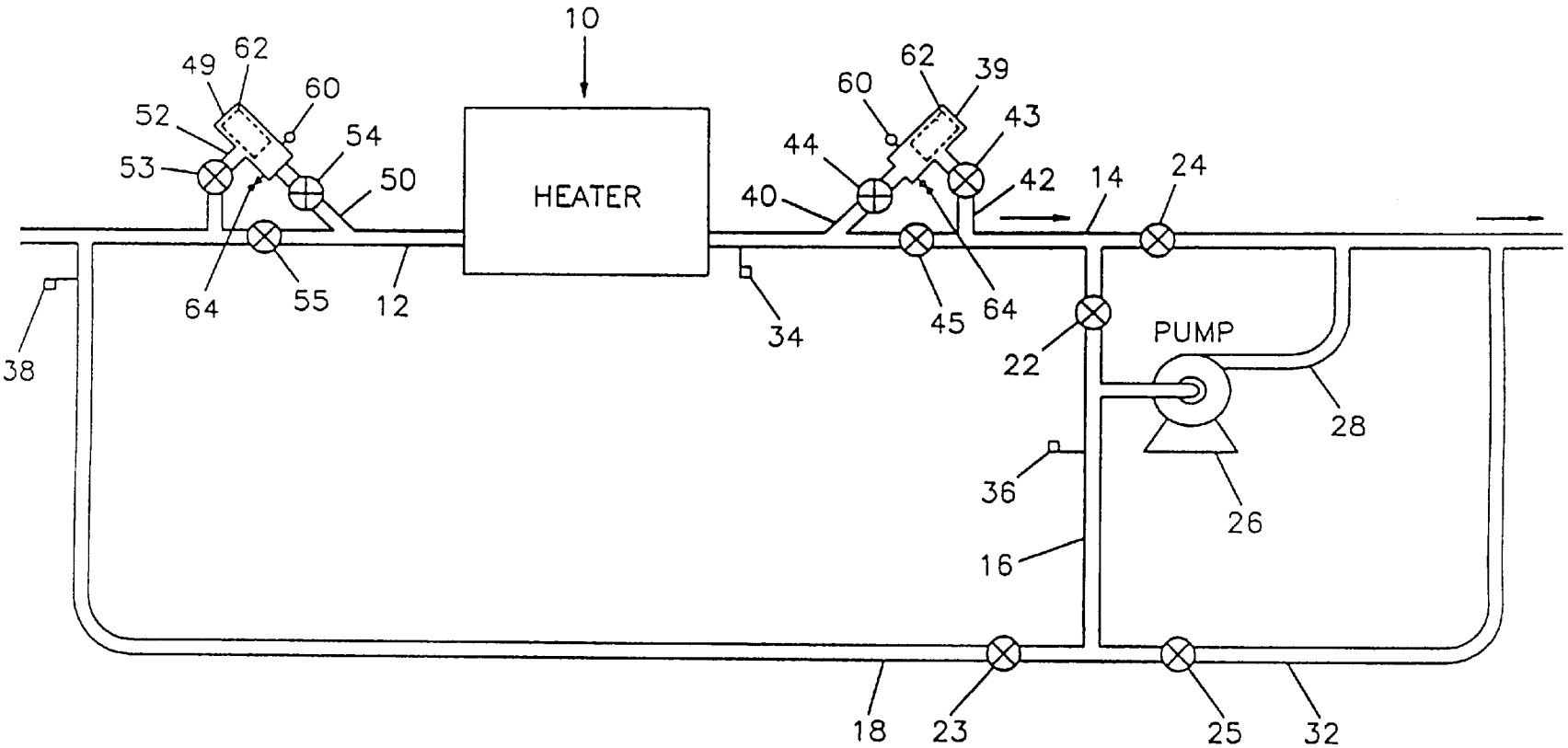
FIG. 1 is a schematic showing the manner of operation of continuous cleaning of a heater while the heater is in operation.

Referring to FIG. 1, a heater 10 may contain as much as 10 kilometers of tubing or pipe running through a convention section and a radiant section from an inlet tube 12 to an outlet tube 14 in several passes. Details of the heater are not shown since the pig is intended for application to existing installations, the general construction of which is well known. The pig is intended for cleaning of the tubing in the heater while fluid being heated is flowing through the heater from the inlet tube 12 to the outlet tube 14. The cleaning may be effected by a single pass repeated periodically as required. The time period between passes depends on the rate of contaminant build up. It is preferred to begin the process with the tubes clean, and thus before establishing continuous pigging while the heater is in operation, it is preferred to clean the tubes thoroughly with repeated passes of a pig while the heater is not operating, since then a very robust scraping action may be obtained with a polymer pig having metallic scraping elements embedded in the polymer pig. Polymer pigs are shown in U.S. Pat. No. 5,358,573, the content of which is herein incorporated by reference. Care must be taken not to damage the tubes while doing the scraping with polymer pigs.

To enable automatic operation of the system according to an embodiment of the method of use of the pig, a return tube formed of tubes 16 and 18 in parallel with the heater tubes is provided between the outlet 14 and inlet 12, with a control valve 22 on tube 16 and return control valve 23 on tube 18. A boost pump 26 on a boost pipe 28 is connected to supply boost fluid to the tube 16. A bypass tube 32 which also forms part of the outlet tubing is also connected in parallel to the boost pipe 28 between the tube 16 and outlet 14. A valve 24 is provided on tube 14, and an outlet valve 25 is provided on tube 32 downstream of the junction between the tube 16 and return tubing 18. Trippers 34, 36 and 38 are provided on tubes 14, 16 and 18 respectively. The trippers 34, 36 and 38 are conventional pig trippers that are activated when a pig passes them. Tripper 38 should be located close to the junction of return tubing 18 with the inlet tubing 12. Close or near in this context means in position where it can be determined when the pig enters the inlet tubing 12. This need not be at the junction if a timer is used and it is known how long it takes for the pig to travel from the tripper 34 to the junction of return tubing 18 and inlet tubing 12. Tripper 34 should be located close to and upstream of the pig launcher 39.

A conventional pig receiver 39 is attached to the tube 14 in parallel by tubes 40, 42 and controlled by valves 43, 44 and 45. The parallel construction permits fluid to flow either through the tube 14 or the pig receiver 39 depending on the positioning of the valves 43, 44 or 45. Pig receiver 39 is used for removal of pigs from the tube. A conventional pig launcher 49 is attached to the tube 12 in parallel by tubes 50, 52 and controlled by valves 53, 54 and 55. The parallel construction permits fluid to flow either through the tube 12 or the pig launcher 49 depending on the positioning of the valves 53, 54 or 55. Pig launcher 49 is used for launching of pigs into the tube. The pig launcher and receiver may be connected to any tube that connects into the tubes 12, 14, 16 or 18, and is preferably on one of the tubes 12, 14, 16 or 18.

Figure 2:
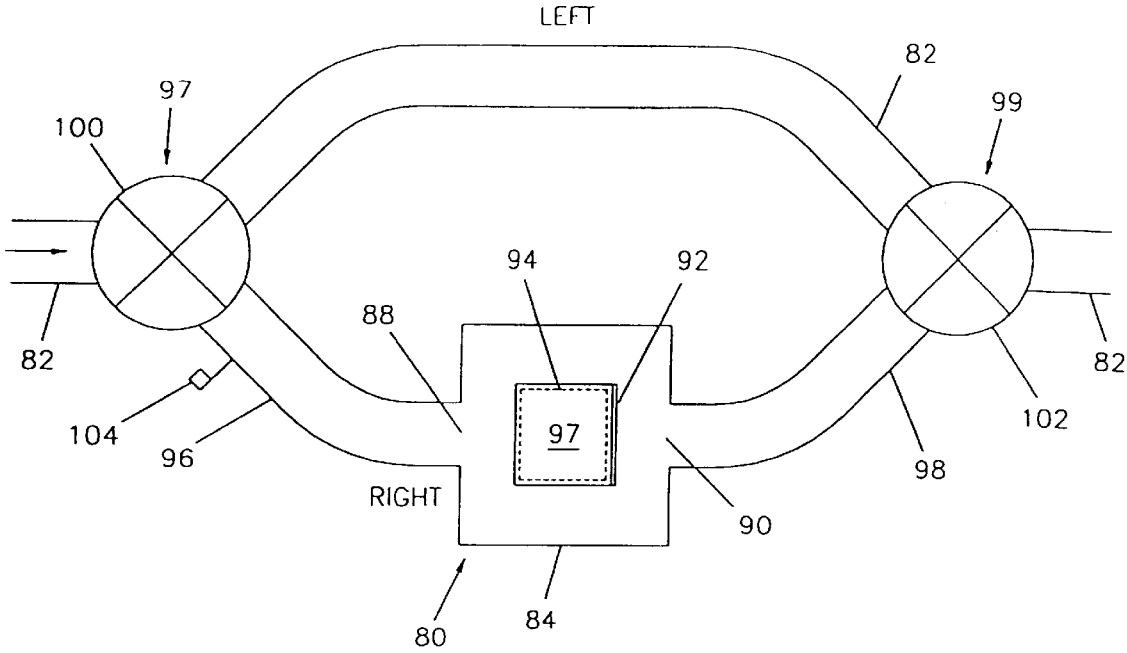
FIG. 2 is a section through a combined pig launcher and receiver that for example may be used in the operation of the invention.

An alternative pig launcher and receiver design is shown in FIG. 2. In this embodiment, there is provided a combined pig launcher and receiver 80, that is mounted parallel to a set of tubing 82 in which fluids may flow, which may for example be the inlet or outlet tubing of a heater or the return tubing 18. The pig launcher and receiver 80 is formed of a pig launcher and receiver body 84, having an interior cavity 86 for receiving pigs. Preferably on opposed sides of the interior cavity 86 there is provided a motive fluid inlet 88 and a motive fluid outlet 90. A door 92 is provided for removal of pigs from and insertion of pigs into the pig launcher and receiver body 80. A basket 94 is installed in the pig launcher and receiver body 80 for holding pigs. Except as described here, the design of the pig launcher and receiver follows conventional design. An inlet pipe 96 is connected to the tubing 82 at a junction 97, which is preferably Y shaped but may be T shaped, and connected to the motive fluid inlet 88. An outlet pipe 98 is connected to the tubing 82 at a junction 99, which is preferably Y shaped but may be T shaped, and connected to the motive fluid outlet 90. A three way full port valve 100 is provided on the inlet pipe at the junction 97. A three way full port valve 102 is provided on the outlet pipe at the junction 99. A tripper 104 is provided on the tubing 82 upstream of the pig launcher and receiver 80.

This alternative pig launcher and receiver design works as follows. The three way full port valves 100 and 102 may direct flow and a pig carried by the flow into the pig launcher and receiver 80 or around the pig launcher and receiver 80 through tubing 82. When the heater tubing is not being cleaned, or a pig is by-passing the pig launcher and receiver 80 valves 100 and 102 are in left open position (tubing 82 is open). When a pig is in the system and needs to be stopped, three way valves 100 and 102 are placed into right position. When the tripper 104 signals a pig has arrived at the pig launcher and receiver 80, the valves 100 and 102 return to left open position. One combined pig launcher and receiver is used for each pass in a heater.

In the normal operating condition, the inlet 12 is at a lower temperature and higher pressure than the outlet 14, and with no pigs in the system, valves 22 and 25 are open, and valves 23 and 24 closed, permitting flow through tubes 14, 16 and 32 which together form an outlet tube. When it is desired to operate the system with a pig, a pig is injected into line 14 through pig launcher 49. To do this, valves 53 and 54 on tubes 52 and 50 respectively are closed, with valve 55 on tube 12 open. A pig may then be placed in the launcher 49. Valves 53 and 54 are opened, and then valve 55 on tube 12 is closed, forcing the pig into tube 12 and into the heater 10. The pig exits the heater through tube 14, and since valve 24 is closed, the pig passes into line 16 and trips tripper 36 which is located on the tubing 16 downstream of the junction of the boost pump connection pipe 28 with the tubing 16. When the pig trips tripper 36, valves 23 and 24 are opened, valves 22 and 25 are closed and boost pump 26 is started. The boost pump 26 provides the required pressure to force the pig to return to the inlet 12 past tripper 38. For an exemplary inlet pressure of 150 psi, and outlet pressure of 110 psi, the boost pump pressure is 200 psi.

When tripper 38 is tripped, boost pump 26 is shut off, valves 22 and 25 are opened and valves 23 and 24 are closed, thus completing the cycle automatically. While pigs are being shunted around the system automatically, the valve 45 is kept open and valve 44 closed. When it is desired to remove pigs from the system, for example for inspection of the pigs, upon tripping of tripper 34 by a pig, valve 45 is closed, and valves 43 and 44 opened, permitting the pig to enter the pig launcher. Valve 45 may then be opened and valves 43 and 44 closed, and the pig may be: removed from the launcher.

Each of the pig launcher 49 and pig receiver 39 contains a basket 62 and pressure gauge 60. The basket permits fluid flow through the receiver, while the pig may be, caught before or in the basket. The pressure gauges 60 inform an operator that the pressure is low enough for the door of the launcher and receiver to be opened. A drain valve 64 is provided in each of the launcher and receiver to permit draining of fluids. The inside diameter of the launcher and receiver should be two sizes larger than the clean inside diameter of the tube being treated. For example, a launcher and receiver inside diameter of 5 or 6 inches would be used for treatment of a 4 inch tube. The launcher and receiver should be made of metal having similar metallurgical properties to the metal of the heater tubes being treated. A door(not shown) is provided on the launcher or receiver in conventional fashion.

The preferred manner of operation of the pig, is to run the pig at a predetermined cycle or time interval. This time interval is established by the operating parameters of the furnace, the process fluid, and by experimentally determined fouling rate onset.

The purpose of the on-stream cleaning method is to inhibit the onset and subsequent formation of coke. This will lengthen the operating period or run-length of a given furnace and maintain furnace operation at the designed peak efficiency.

Starting with a clean and polished pipe, the coke onset period has been determined by laboratory experiments to be from minutes to as long as 18 hours. This period of onset is the most crucial time period during which the cleaning or wiping action of the on-line pig has to be performed. At this point in the operating cycle, it is not practicable to measure any temperature changes that would reflect fouling with conventional sensing elements, since the temperature changes would be measured in millidegrees. The time interval of running the on-line pig is best established by the operating conditions and analyzing coke build up in the tubing under the operating conditions. Under laboratory conditions, the coke onset and the amount is actually determine by weight. This is then converted into a time period characterizing the differing thicknesses of coke build-up.

Once coke buildup has occurred and temperature changes can be observed, the underlying coke layer is likely to be too hard to be removed with an on-line pig. Only the most recent formation on top of the already formed coke layer is expected to be able to be wiped away. Wiping away a new, thin and soft layer of coke before it builds up is believed to retard the progression of coke formation and extend the run time period. Thus, it is preferred to run the pig repeatedly through the tubing before the contaminant as hardened, or solidified. Initially, coke in a hydrocarbon stream is in a creamy state, but solidifies and hardens in the time frame mentioned above.

It is the extension of the run time together with the energy savings by virtue of improved efficiency, that on-line cleaning is expected to have its most significant accomplishment. Eventually, it is expected that build up of coke will necessitate removal by conventional pigging.

Thus, it should be clarified that it is not prudent to rely solely on conventional monitoring methods, but rather indirect means should be used to establish cleaning run intervals. Conventional monitoring methods may also be used to augment the pigging control process.

Thus, automatic cleaning of the heater tube may be effected whenever there is a degradation of efficiency of the heater. Efficiency of the heater may be monitored by monitoring the temperature at the outlet 14 of the heater 10 with a conventional temperature sensor. For a given heat input to the heater 10, the fluid in the tube will be heated a lesser amount when there is a greater amount of contamination in the tube. The contamination in effect acts as an insulator for the fluid in the tube. Hence, when the temperature at the outlet 14 of the heater 10 indicates a degradation of efficiency of the heater 10 below a given set point, a pig may be run through the tube in the manner described to clean the tube while the heater is operating.

The on line cleaning of the heater may also be controlled by other process parameters such as pressure, change in temperature or pressure from inlet to outlet or volumetric flow rate. Conventional devices may be used for monitoring these parameters.

The tubes, valves and launchers should all be made of similar metal to the metal in the heater tubes. The pig should be made of similar metal. The pig must be able to bend sufficiently to move around the bends in the tubes.

Any pig used in the operation of the invention should be dimensioned to fit within the tube with its cleaning elements able to compress against contaminants in the tube and effect a scraping action. The pig itself is constructed to bias the cleaning elements against the contaminants.

Figure 3:
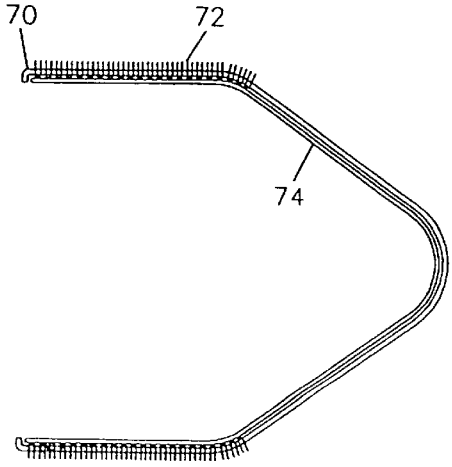
FIG. 3 is a section through a pig that may be used during the operation of the invention.

An exemplary hollow metallic pig is shown in FIG. 3. An exterior partly cylindrical and partly conical shell 70 is made of spring metal of the same material that the tubes in the heater are made from, or such other material that will withstand the high temperature corrosive conditions within the heater tubes. Bristles or metallic wires 72 acting as cleaning elements are formed into Ushapes and pass through openings in the cylindrical portion of the shell 70 in conventional fashion for forming a brush with bristles. The metallic wires 72 extend circumferentially around the cylindrical portion of the conical shell 70. Other methods of securing the wires 72 may be used. An interior cylindrical and conical shell 74 of similar but slightly smaller cross-section than the conical shell 70 is pressed into the conical shell 70 to assist in securing the metallic wires 72 in the conical shell 70. An annular lip 76 holds the interior shell 74 inside the exterior shell 70. The metallic wires 72 and the shell 74 should be made of the same material as the shell 70 or a material having equivalent characteristics.

A preferred pig designed in accordance with the invention is shown in FIGS. 4–8. Referring to FIGS. 4–8, there is shown a pig for cleaning tubes which is in the form of a tubular mesh 110 made of flexible abrasive material. The tubular mesh 110 forms a body having a circular cross-section in a plane perpendicular to the axis of the tubular mesh. A suitable flexible abrasive material is 304 or 316 stainless steel wire, cold rolled to a square, rectangular, flat, or other polygonal cross-section as shown by wire 111 shown in FIG. 6. The wire 111 may be plated, coated or bi-metallic, and may be annealed or heat treated. A square cross-section is preferred, but the wire may be in the form of a ribbon. In the case of a soft scale, a rounded wire could be used, a line running along the outermost longitudinal surface of the wire thus forming a scraping edge, but it is preferred that the scraping edge be angular. Other materials may be used for the wire besides metal if they are sufficiently hard, flexible and robust for the scraping action. For high temperature applications, a heat resistant metal such as Inconel™ 600 or other nickel alloy may be used. However, other materials including other metals and ceramics may be used, depending on the intended application. The selection of an appropriate metallurgy for cleaning a tube is well within the skill of a person in the art. For example, it is well known that the hardness of the abrasive material should not exceed the hardness of the tube or other fittings such as valves in the tube system. In addition, the material should not corrode easily within the tube operating environment. The square edges 113 of the wire 111 form scraping edges on the outer periphery of the tubular mesh 110. These scraping edges 113 extend longitudinally (lengthwise) along the wire 111. The scraping edges preferably lie in planes perpendicular to an axis of the body, and at least lie at an angle sufficient to effect a scraping action. In the case of a cylindrical body, the axis is the central axis of the cylinder. In the case of a spherical body, any diameter is an axis. For high temperature applications, and particularly for operation at temperatures over 500° F., based on currently available polymers, the pig should be made entirely of metal or a similar material such as flexible ceramic, and have no polymeric material associated with it. The tubular mesh or metallic wire should preferably be unconstrained by other material, such as that of a solid pig, to permit it the flexibility to adapt to different sizes of pipes.

Figure 4:
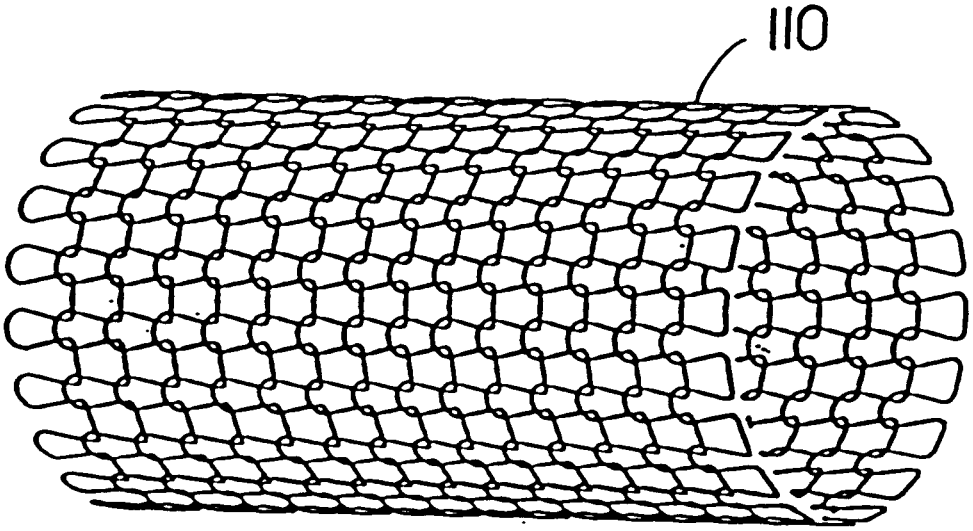
FIG. 4 is a perspective view of a knitted tubular mesh pig according to the invention.
Figure 7:
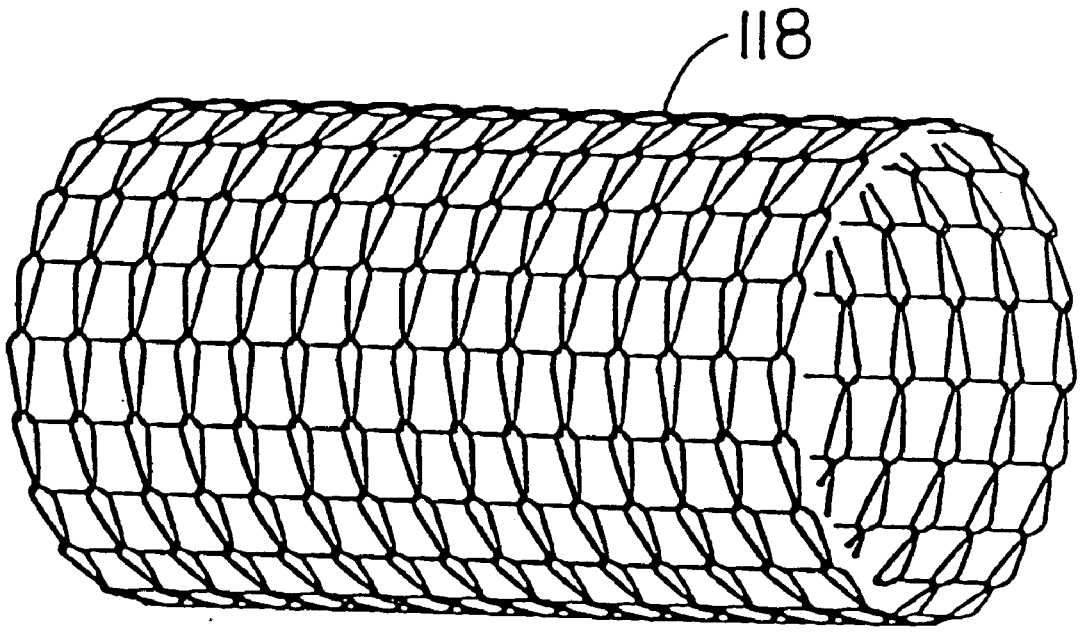
FIG. 7 is a perspective of a tubular mesh pig in which the knit is at right angles to the knit of FIG. 4.

The tubular mesh may be a knit (FIGS. 4, 4A, 4B, 5B and 7) or a weave (FIG. 8) or may be knotted, not shown. In the case of the knit, the loops 112 (FIG. 4A) may be oriented parallel to the longitudinal axis of the tube (FIG. 4) or may, preferably, form a tubular mesh 114 with loops 112 oriented at any appropriate angle, for example perpendicular, to the longitudinal axis of the tube (FIG. 7). Double knitted loops 116 are shown in FIG. 4B. The knit shown in FIGS. 4A and 4B when used in the orientation of tubular mesh 118 shown in FIG. 7 is capable of radial expansion from full compression to twice the diameter. As an, example, a tubular mesh 8 inches in diameter in the fully expanded condition will fit within a tube having inner diameter of 4 inches when fully compressed. A slight overcompression to less than half the original diameter is also possible by overlap of some of the loops of the knit. In the fully compressed position, there is little, if any, bypass of motive fluid. As the tube expands downstream, the mesh will expand up to 8 inches in diameter. In general any knit may be used, though it is preferred that the tubular mesh have an axial view profile that is as close to circular as is practicable. That is, it is preferred that the knit not be ribbed, but present a smooth outer circumference when viewed along the axis of the tubular mesh. This ensures complete circumferential cleaning of a pipe.

For a 4 inch diameter tubular mesh, a wire of 0.013 inches cross-section is suitable. For an 8 inch diameter tubular mesh, a wire of 0.025 inches cross-section is suitable. The diameter of the tubular mesh is chosen to suit the intended application. If the tubular mesh is to be used in tubes of variable sizes, then a tubular mesh whose range of expansion will cover all tube sizes, or as many as possible, should be chosen.

Figure 4A:
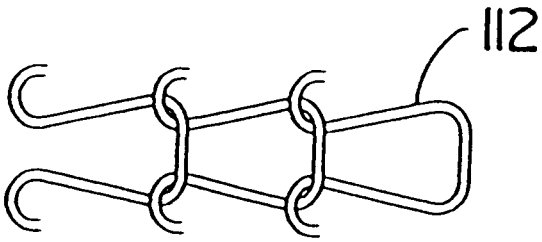
FIG. 4A is a detail of a first knit that could be used to make the pig of FIG. 4 or FIG. 7.
Figure 4B:
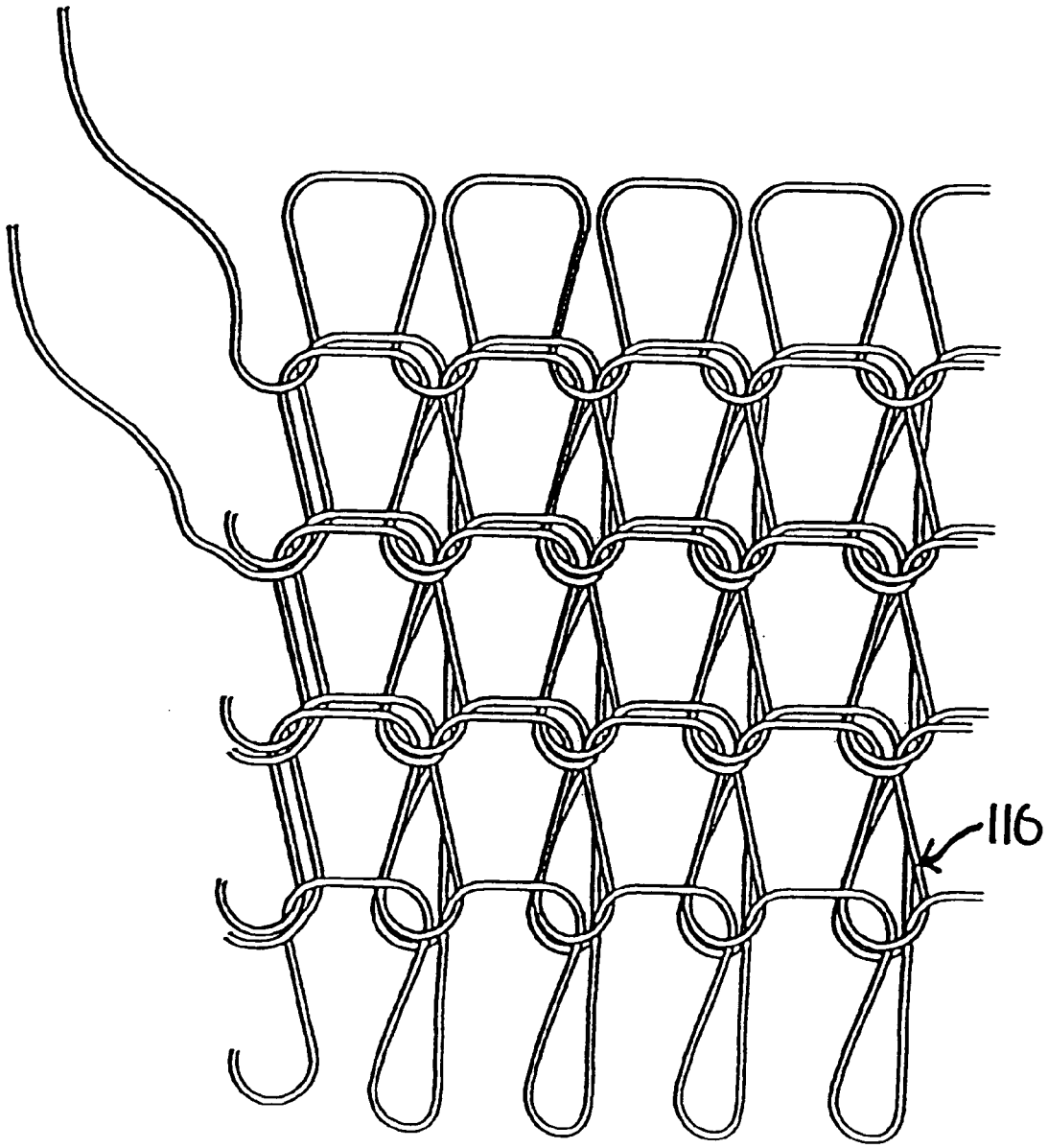
FIG. 4B is a detail of a second knit used to make the pig of FIG. 4.
Figure 5A:
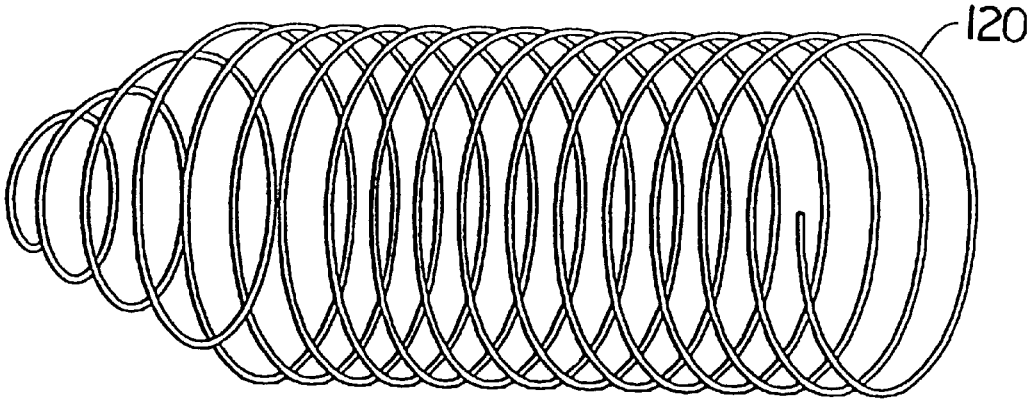
FIG. 5A is a perspective view of an expander for use with the tubular mesh pig of FIGS. 4 and 7.
Figure 5B:
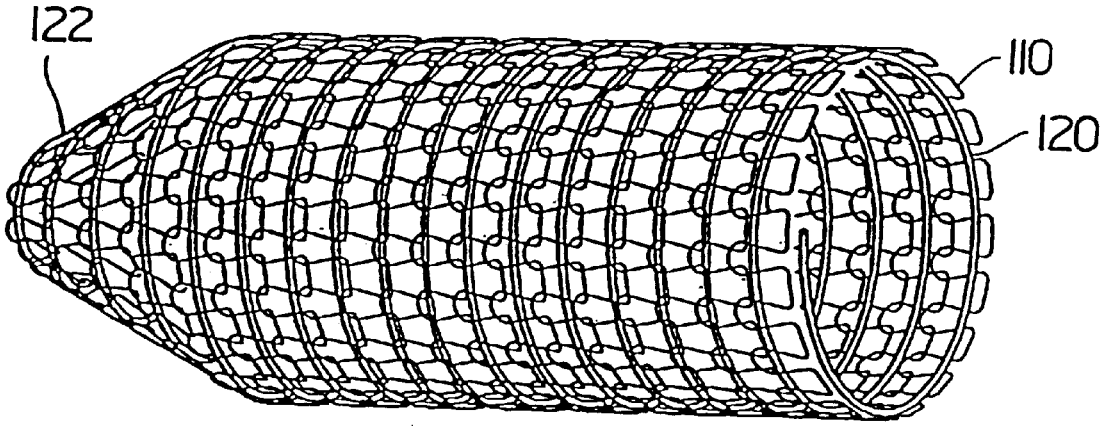
FIG. 5B is a perspective view of the expander of FIG. 5A inside the tubular mesh pig of FIG. 4.
Figure 6:
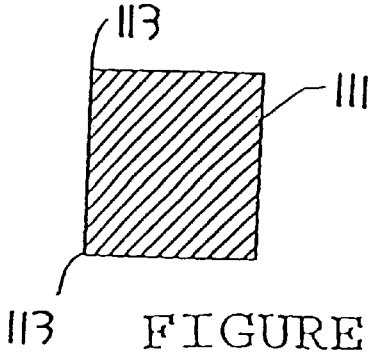
FIG. 6 is a section through a wire thread used to make the mesh of the tubular mesh pigs of FIG. 4 and FIG. 7.

Although the tubular mesh of FIGS. 4A–4B and 7 is self-expanding under pressure, it is preferred to provide an expander 120 (shown in FIG. 5A) biased against the tubular mesh 110 for urging the tubular mesh radially outward (as shown in FIG. 5B). The expander 120 may be used to control the force applied to the inside wall of the pipe to control the cleaning action. In addition, the bias force applied by the expander 120 regulates the speed at which the device travels in the tube. The expander 120 in FIG. 5A is in the form of a helical wire spring. The wire size may be varied to vary the tension in the spring. Other shapes of expander may be used. A simple helix is not required, and a wire expander could have various contortions of wire. The expander 120 may be symmetrical, tapered at both ends, or be tapered at only one end. In addition, the expander 120 may have control surfaces or apertures that allow more or less fluid to bypass the expander 120 and thus control the speed of the expander. The expander 120 may itself be considered a body with circular cross-section perpendicular to its axis and may itself be used to form a pig, without using the tubular mesh. In this case, the expander 120 is preferably made of the same wire as described above for the tubular mesh, with scraping edges extending along the wire, hence around the outer periphery of the expander.

Figure 5C:
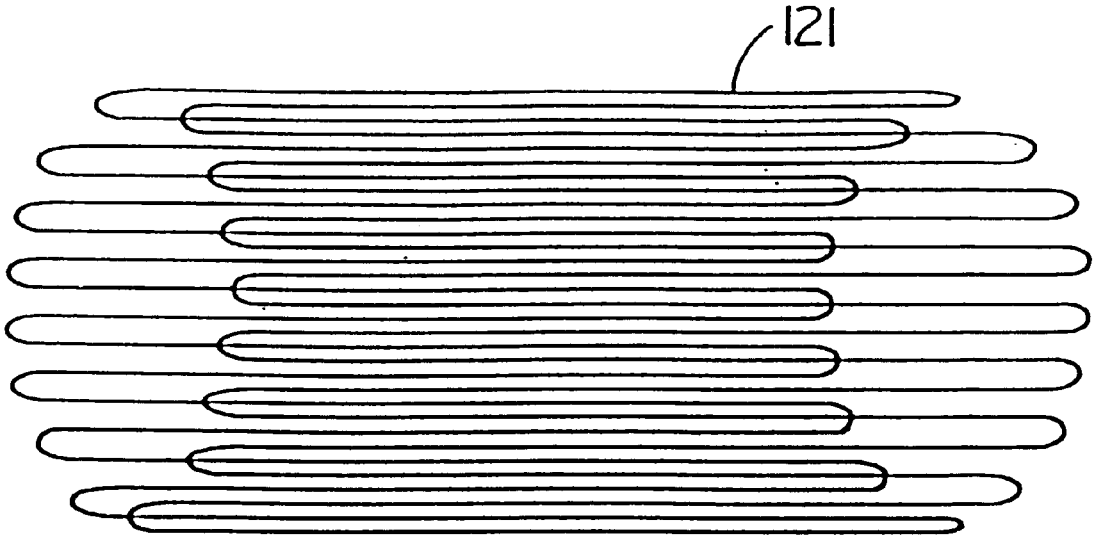
FIG. 5C is a perspective view of a further embodiment of pig made from a wire.

The expander of FIGS. 5A and 5B has the disadvantage that since its expansion requires its loops to move circumferentially any friction between the expander loops and the tubing or the mesh will tend to prevent the expander from expanding. Thus, it is preferred to make the expander, as shown in FIG. 5C, made of lengthwise wire 121. For use as a pig in itself, this expander has less efficient coverage since the scraping edges that carry out the scraping function are then effectively only the end pieces, which tend to become worn, and thus are not preferred. An alternative is to have the wire 121 be wavy along the length between the end pieces, so as to provide more scraping action.

The body of the pig may also be spherical and could in one embodiment consist of a ball of wire or wires compressed together with random portions of the wire forming the outer periphery of the ball.

In operation, the tubular mesh 110 or 118 should be tapered at one end 122 (shown in FIG. 5B) with the mesh bound together at the apex of the taper to close the end of the tubular mesh. For a knit, this can be done with a wire loop, or the loops may be welded together or otherwise secured or tied together. The expander should be capable of expanding the diameter of the tubular mesh 100% and at least 50% of its initial diameter.

Figure 8:
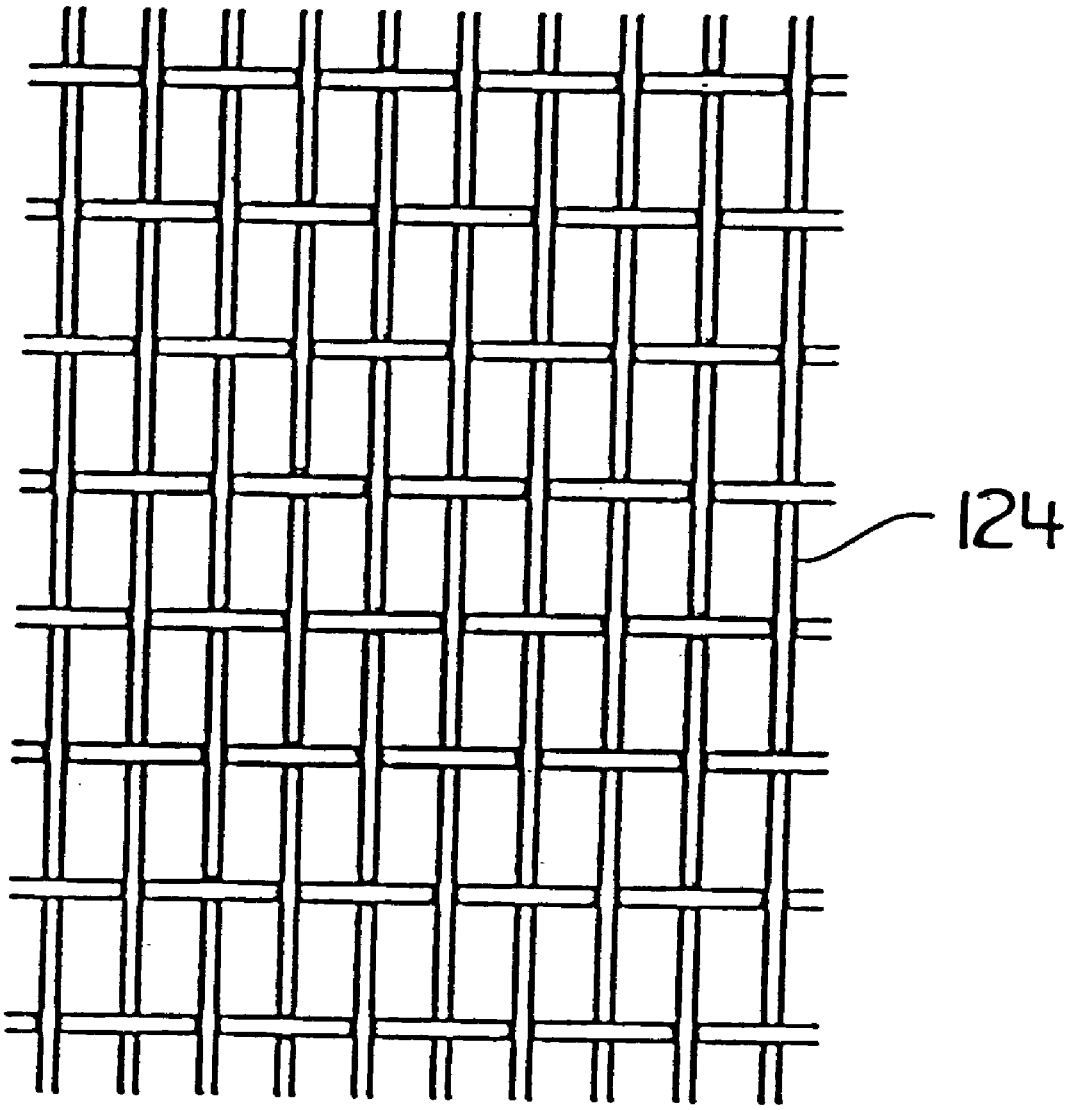
FIG. 8 is a perspective view of a woven tubular mesh pig.

The tubular mesh shown in FIG. 4, 5B or 7 may also be made from a weave 124 shown in FIG. 8. In this instance, the weave should be at 45° to the longitudinal axis of the tubular mesh, and the edges of the mesh should be welded together to prevent unravelling. In this example, the tubular mesh compresses axially when it expands radially, and vice versa. The tubular mesh 10 or 18 should be at least 20% longer than the biggest ID of tubing to be cleaned to prevent cross-ways motion of the tubular mesh through the tube.

The pipe pig of the present invention is propelled through a heater either using conventional methods or using the new method of operational fluid (liquid, gas or a mixture of liquid and gas) passing through the heater while the heater is operating. The pipe pig can be circulated through the tubes of the heater as often as is required to clean the heater. When commencing a continuous operation, it is preferred to get the tube very clean first, and then continuously cleaning a small amount of and preventing build up of thick deposits. While the tubing is very hot, as it is during operation, the coke tends to be soft and to be removed easily.

While the system may be manually operated, it is preferred to operate the system automatically. For this purpose, a control system may be connected to the trippers, valves, boost pump and pig launcher and receiver for controlling their operation in accordance with the operating principles outlined herein. Other than as described, the tubing, trippers, valves, and boost pump mentioned herein are all conventional.

It should be appreciated that FIG. 1 is not to scale. In practice, both inlet 12 and outlet 14 may pass out of the heater in close proximity to each other, and thus the return tubing 18 may be a very short length.

Figure 9:
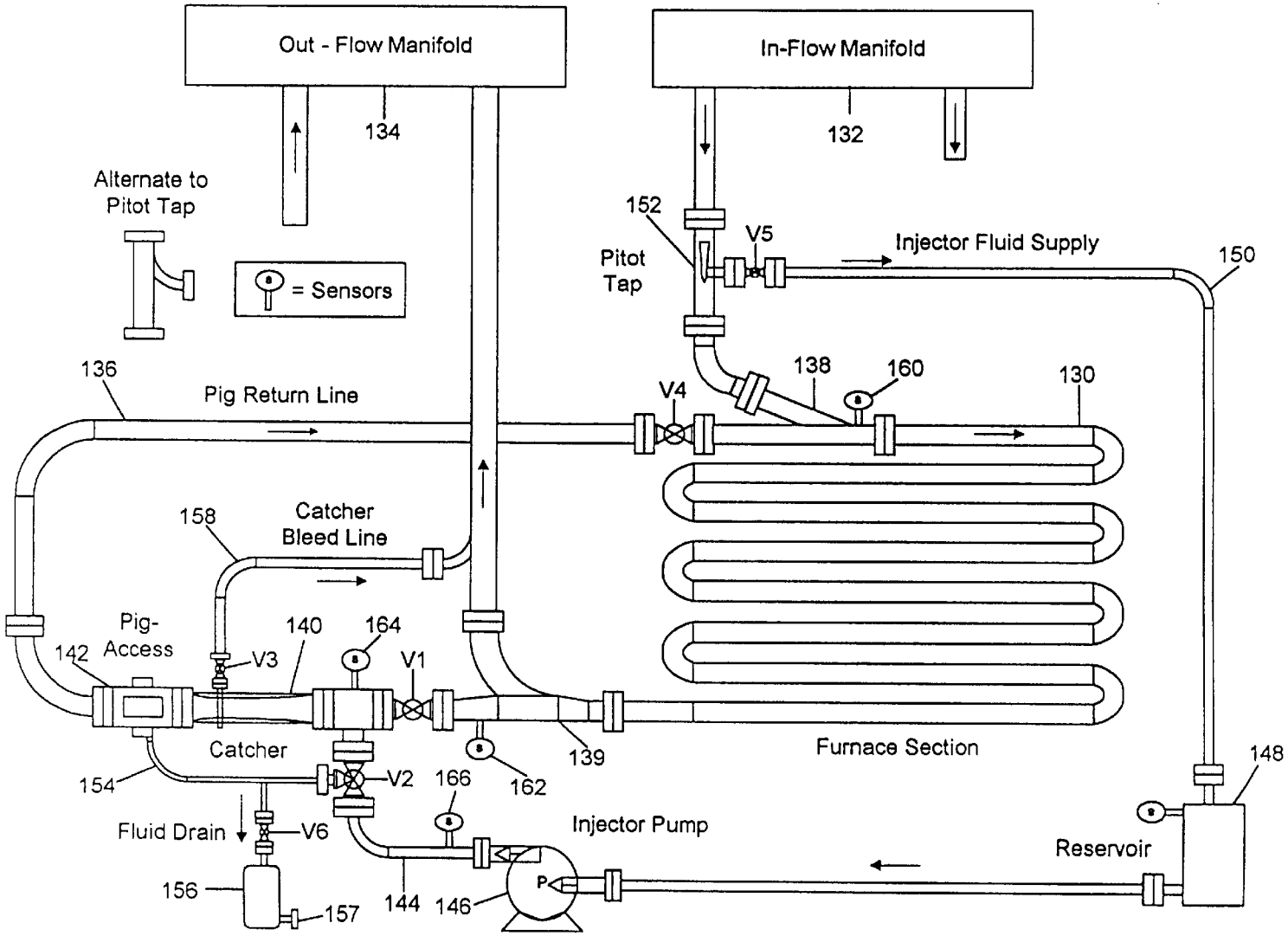
FIG. 9 is a schematic showing a first embodiment of an apparatus for performing an embodiment of the method of the invention.

FIG. 9 shows an apparatus that may be used to pig an operating heater with one of the pigs described herein. A tube or pipe 130 in the furnace section of an operating heater is supplied fluid from an in-flow manifold 132 in conventional manner and discharges fluid in conventional manner through outflow manifold 134. A pig return line 136 is connected in parallel to the tube 130 between the inlet and outlet of the tube 130 at junctions 138 and 139. Valves V1 and V4 at the junctions 139 and 138 respectively isolate the pig return line 136 from the tube 130. A pig catcher 140 and pig access port 142 are provided on the pig return line 136 between V1 and V4. Drive fluid for driving the pig along the pig return line 136 is provided through line 144 and valve V2. Motive power is provided by pump 146 on line 144. The pump 146 accesses fluid from a reservoir 148, which may for example obtain fluid from line 150 which connects at pitot tap 152 to the tube 130. Flow along lines 150 and 144 is controlled by valves V5 and V2. A fluid return line 154 is provided between pig access port 142 and valve V2. A fluid drain 156 with flow controlled by valve V6 is provided on line 154. A catcher bleed line 158 with valve V3 connects the pig catcher to the tube 130 outflow line. Pig signalling devices 160, 162 and 164 are located at the junction 138, junction 139 and pig catcher 140 respectively. A pressure sensor 166 is located near the injector pump, and a pressure sensor 168 is located on the reservoir 148.

The apparatus of FIG. 9 works as follows. A pig is placed in pig access port 142 with V1–V6 all initially closed. V5 is opened, the pump 146 is started and then valve V2 is opened to place pressure on the pig. V4 is then opened until the pig trips pig signalling device 160. After the pig passes the junction 138, V4 is closed, and then V2 and V5 are closed. V6 may be then opened and closed to drain the pig launcher 142. The pig circulates through the tubes 130 until it reaches junction 139 where its momentum carries it towards V1. V1 is opened (either based upon timing after V4 closes, or opened when V4 closes or by sensing the location of the pig in the tubes 130 as it nears V1) and the pig is pushed by pressure from fluid in the tubes 130 into the pig catcher 140. V3 is also opened to allow return of fluid into the out flow manifold 134. The pig catcher 140 is shown as a restriction in the line, but the catching function may be carried out by throttling V3 to place back pressure on the pig in the catcher 140. Once the pig is in the catcher, which may be sensed by passage of the pig past sensor 162 or by another sensor, V1 and V3 are closed. The cycle may then be repeated as desired. Pump 146 is preferably a variable pressure pump, since it is preferably to maintain the pressure in line 136 slightly higher than the pressure in the line 130 at the junction 138. Sensor 166 may be used to sense the pressure supplied by the pump 146, and the pressure varied accordingly. In addition, it is desirable to avoid any back flow in line 144 that could damage the pump.

Figure 10:
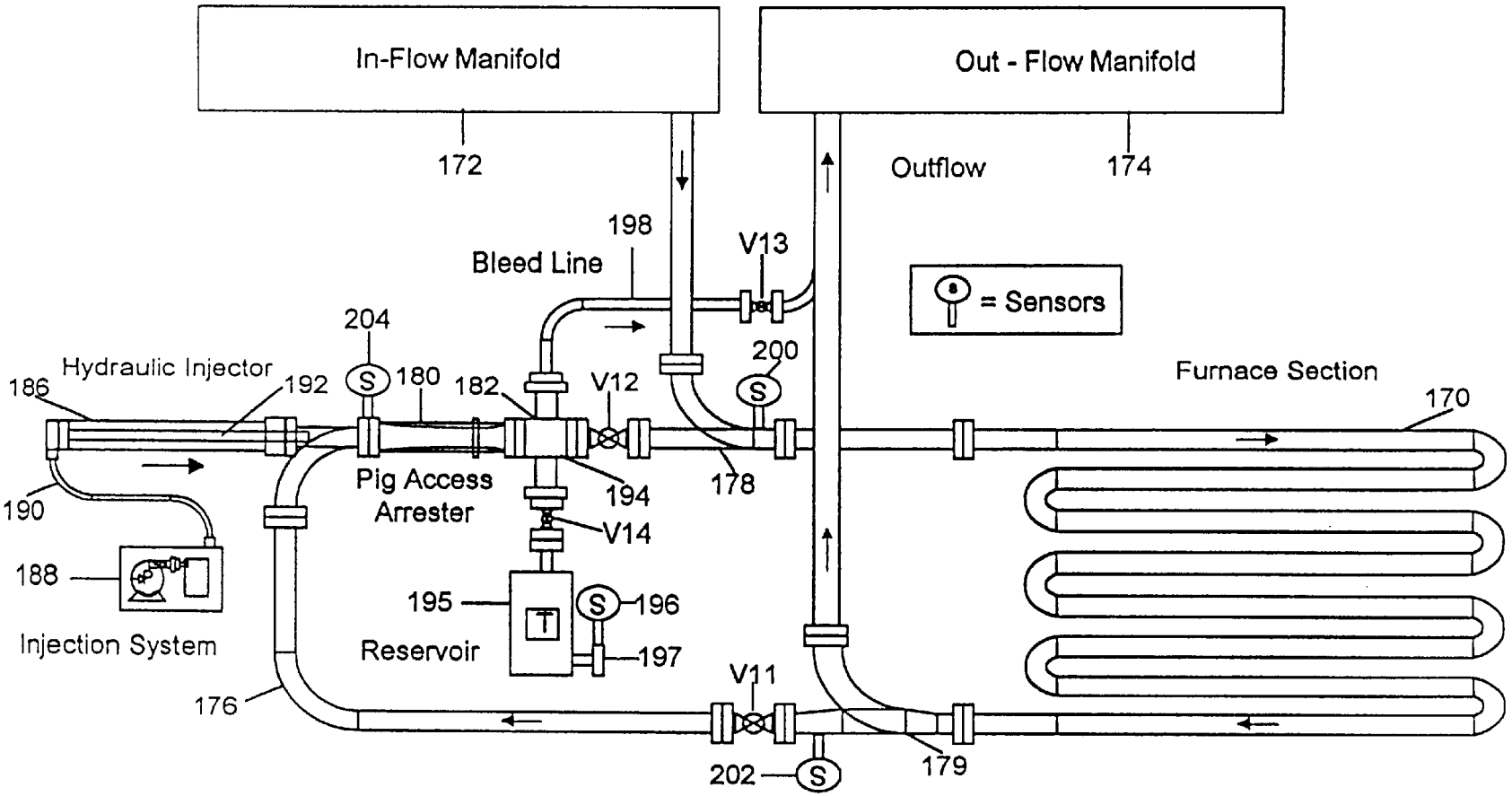
FIG. 10 is a schematic showing a second embodiment of an apparatus for performing an embodiment of the method of the invention.

Referring to FIG. 10, a tube or pipe 170 in the furnace section of an operating heater is supplied fluid from an in-flow manifold 172 in conventional manner and discharges fluid in conventional manner through outflow manifold 174. A pig return line 176 is connected in parallel to the tube 170 between the inlet and outlet of the tube 170 at junctions 178 and 179. Valves V11 and V12 at the junctions 179 and 178 respectively isolate the pig return line 176 from the tube 170. A pig catcher 180 and pig access port 182 are provided on the pig return line 176 between V11 and V12. A drive mechanism for driving the pig into the pig return line 176 is provided by a hydraulic injector 186 coupled to a hydraulic fluid injection system 188 through line 190. The hydraulic injector 186 has a ram 192 which is extendible into the pig arrester 180 by action of hydraulic fluid in the injector 186. A fluid return line 194 with V14 is provided between pig access port 182 and a drain reservoir 195. Sensor 196 detects when reservoir 195 is full and requires emptying through outlet 197. A catcher bleed line 198 with valve V13 connects the pig catcher to the tube 170 outflow line. Pig signalling devices 200, 202 and 204 are located at the junction 178, junction 179 and pig catcher 180 respectively.

The apparatus of FIG. 10 works as follows. A pig is placed in pig access port 182 with V11–V13 all initially closed. V12 is opened, the hydraulic actuator 186 is activated to drive a pig into the line 170. After the pig passes sensor 200, V12 is closed and V11 and V13 are opened.

Figure 11:
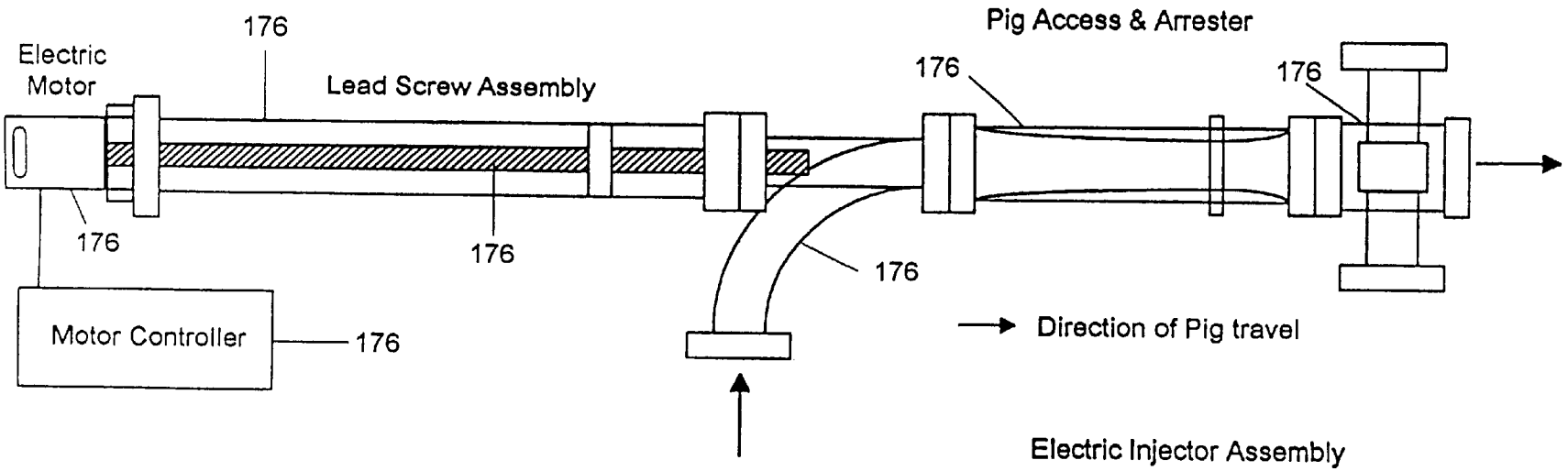
FIG. 11 is a schematic showing an electric injection assembly for use with the apparatus of FIG. 10.

The pig circulates through the tubes 170 until it reaches junction 179 where its momentum carries it towards V11. V1 is open and the fluid exiting the catcher 182 through bleed line 198 carries the pig into the catcher 180. The pig catcher 180 is shown as a restriction in the line, but the catching function may be carried out by throttling V13 to place back pressure on the pig in the catcher 180. Once the pig is in the catcher, which may be sensed by passage of the pig past sensor 204 or by another sensor, V11 and V13 are closed. V14 is opened to drain fluid from the pig catcher 180 and pig access port 182. The cycle may then be repeated as desired. A variation of the pig return drive mechanism shown in FIG. 10 is shown in FIG. 11, wherein an electric ram 208 is used with a lead screw 210 replacing ram 192, and a motor 212 with motor controller 214 replacing the hydraulic drive 188 of FIG. 101.

Figure 12:
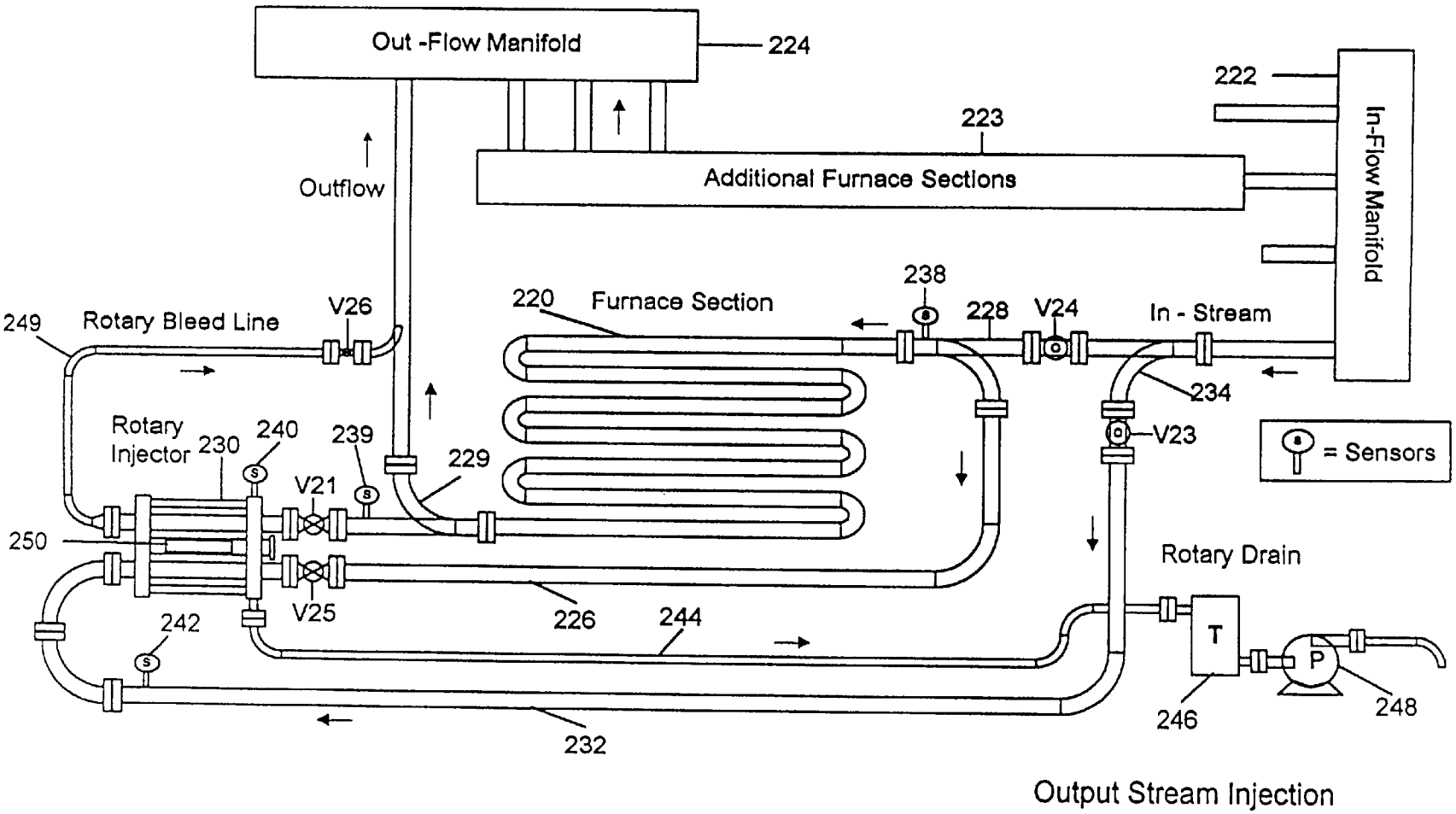
FIG. 12 is a schematic showing a third embodiment of an apparatus for performing an embodiment of the method of the invention, which uses a rotary pig injector.

Referring to FIG. 12, a tube or pipe 220 in the furnace section of an operating heater is supplied fluid from an in-flow manifold 222 in conventional manner and discharges fluid in conventional manner through outflow manifold 224. Various other furnace sections 223 may also be treated in like manner. Pig return line 226 is connected in parallel to the tube 220 between the inlet and outlet of the tube 220 at junctions 228 and 229. A rotary pig injector 230 is provided on the pig return line 226 between V21 and V25. Valves V21 and V25 at junction 229 and on the other side of the rotary pig injector 230 respectively isolate the rotary pig injector 230 from the tube 220. A drive mechanism for driving the pig into the pig return line 226 is provided by a line 232 connected to the inflow line at junction 234 and to the rotary pig injector 230. V23 at junction 234 controls fluid flow into the line 232. V24 controls fluid flow on the inflow line between junction 234 and 228. V25 on line 226 at the rotary injector 230 also controls flow of fluid in line 226. Sensors 238, 239, 240 and 242 are provided respectively at junction 228, junction 229, rotary injection 230 and on line 232 near the rotary injector 230. A drain line 244 is provided on the rotary injector 230, which drain line 244 discharges through reservoir 246 and pump 248. A catcher bleed line 249 with valve V26 connects the pig catcher to the tube 220 outflow line.

The rotary pig injector 230 is shown in FIGS. 14A–14D. The pig injector 230 has a rotating barrel 252 with a chamber 250 in the rotating barrel. Flanges 254 and 256 retain the rotating barrel 252. Ports 258 and 260 in the flanges 254 and 256 respectively connect between the tube 220 and the bleed line 249. Ports 262 and 264 in the flanges 254 and 256 respectively connect between the tube 226 and 232. A single port 266 in flange 256 permits access to the chamber 250 from the outside for emplacement and recovery of pigs into and out of the chamber 250. The chamber 250 may rotate from being between ports 258 and 260 (RETRIEVE position), to connecting with port 266 (ACCESS position) and to being between ports 262 and 264 (LAUNCH position). Any suitable means, such as a chain drive (not shown) may be used to rotate the barrel 252.

The apparatus of FIG. 12 works as follows. A pig is placed in chamber 250 of rotary injector 230 through port 266 with all valves except V24 initially closed. V23 and V25 are opened to fill lines 226 and 232 with fluid. The chamber 250 is rotated to the LAUNCH position and the pig enters line 226. V24 is then closed and the pig is driven through line 226 into the tubes 220 and past sensor 238. When the pig trips sensor 238, V24 is opened, and V23 and V25 are closed. Chamber 250 and lines 232 and 226 are then drained through line 244. Chamber 250 is rotated to the RETRIEVE position. The pig is driven by operating fluid through the tube 220 to junction 229 where it trips sensor 239 and V21 and V26 open to allow the pig to enter chamber 250. V21 and V26 are then closed, and the bleed line 249 and chamber 250 may be drained through line 244. The pig may then be returned to the LAUNCH position to continue the cleaning cycle as required, or returned to the ACCESS position for retrieval. The rotary injector 230 is not preferred due to the difficulty of sealing the chamber 250 in the LAUNCH and RETRIEVE positions.

Figure 13:
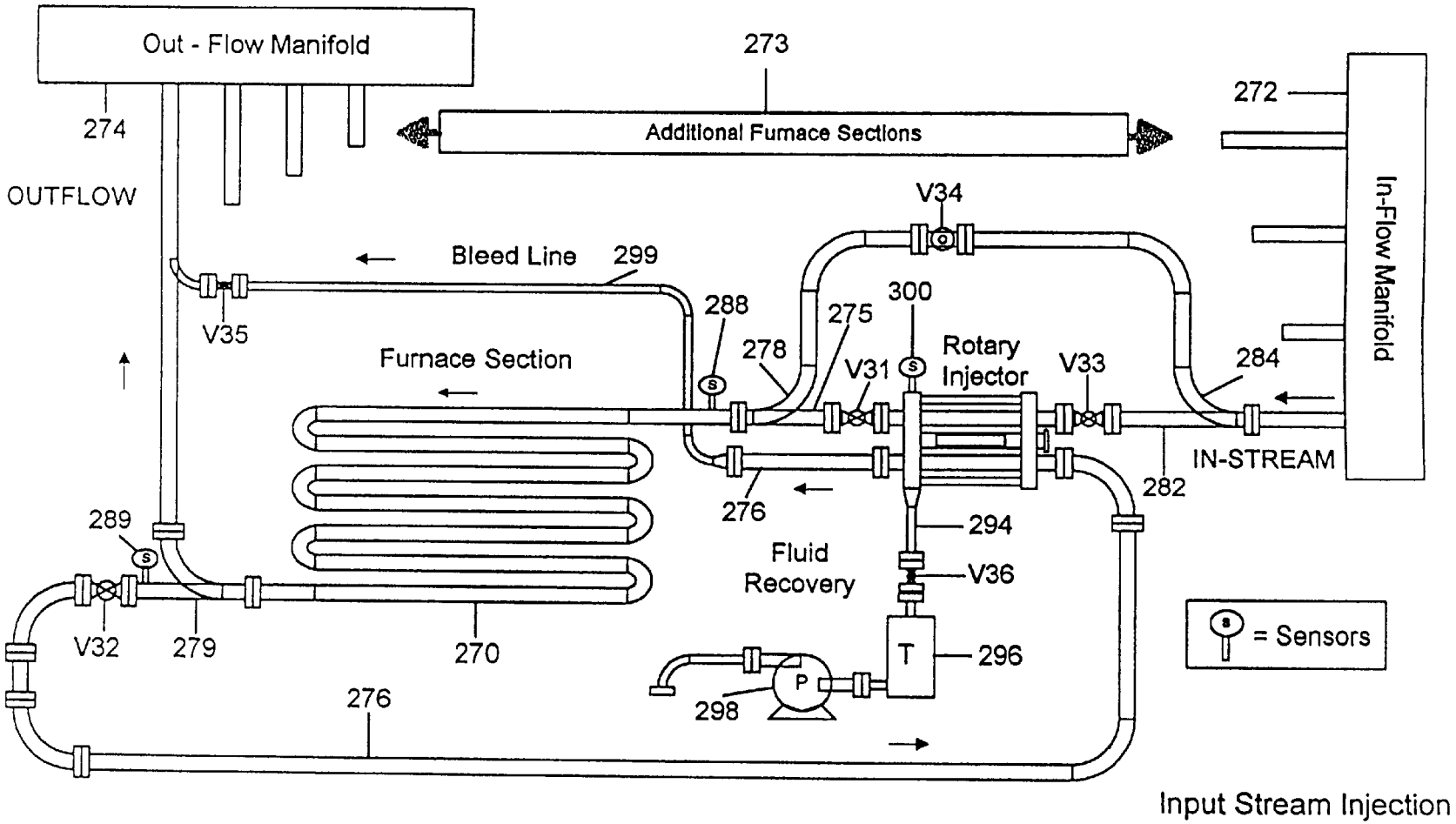
FIG. 13 is a schematic showing a fourth embodiment of an apparatus for performing an embodiment of the method of the invention using a rotary pig injector.
Figure 14C:
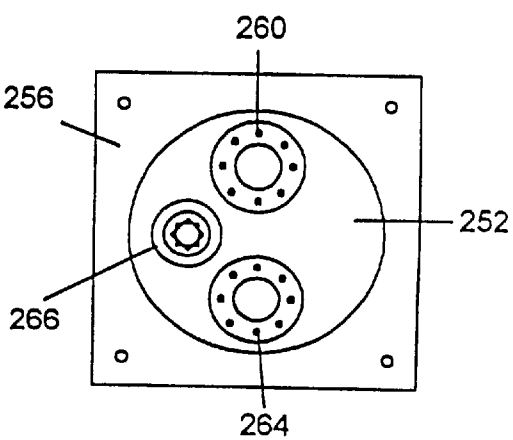
FIGS. 14A, 14B, 14C and 14D are respectively a first end view, top view, second end view and front view of a rotary injector for use with the apparatus of FIGS. 12 and 13.
Figure 14B:
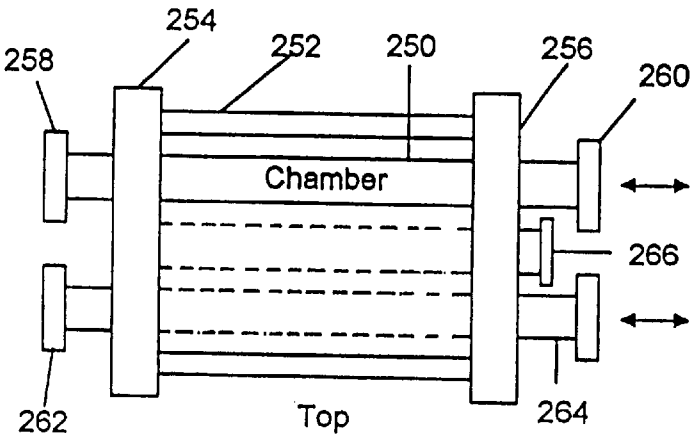
Figure 14D:
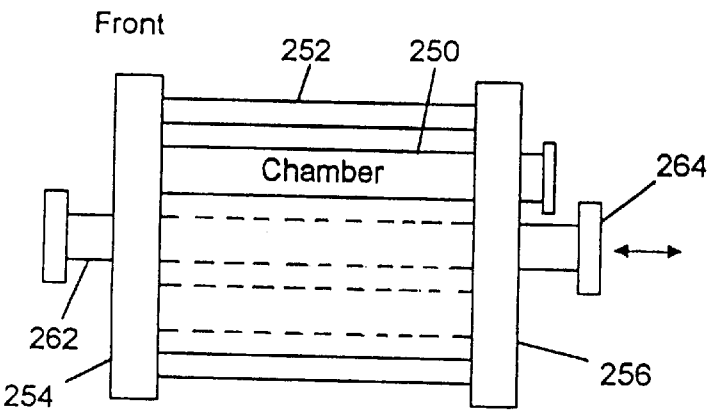
Figure 14A:
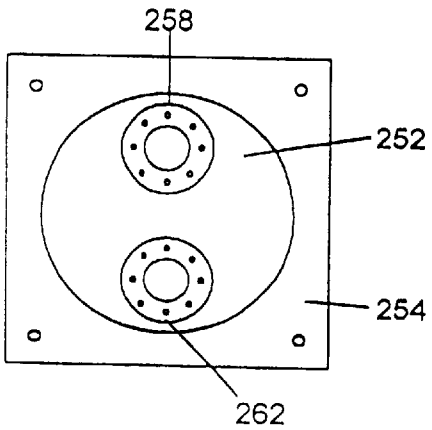

A further embodiment of pig return system is shown in FIG. 13. Referring to FIG. 13, a tube or pipe 270 in the furnace section of an operating heater is supplied fluid from an in-flow manifold 272 in conventional manner and discharges fluid in conventional manner through outflow manifold 274. Various other furnace sections 273 may also be treated in like manner. A pig return line 276 is connected in parallel to the tube 270 between the inlet and outlet of the tube 270 at junctions 278 and 279. A rotary pig injector 230 (same as the one shown in FIG. 12) is provided on the pig return line 276 between V31 and V32. Valves V31 and V32 at junction 278 and junction 279 respectively isolate the rotary pig injector 230 from the tube 270. A drive mechanism for driving the pig into the pig return line 276 is provided by a line 282 connected to the inflow line at junction 284 and to the rotary pig injector 230. V33 at junction 284 controls fluid flow into the line 282. V34 controls fluid flow on the inflow line between junction 284 and 278. Sensors 288 and 289 are provided respectively at junction 278 and junction 279. A drain line 294 controlled by valve V36 is provided on the rotary injector 230, which drain line 294 discharges through reservoir 296 and pump 298. A catcher bleed line 299 with valve V25 connects the pig catcher to the tube 270 outflow line. Sensor 300 is supplied on the rotary pig injector to detect when the pig exits the rotary injector.

The apparatus of FIG. 13 works as follows. A pig is placed in chamber 250 of rotary injector 230 through port 266 with all valves except V34 initially closed. V33 and V31 are opened to fill line 282 with fluid. The chamber 250 is rotated to the LAUNCH position and the pig enters line 275. V34 is then closed and the pig is driven through line 275 into the tubes 270 and past sensor 288. When the pig trips sensor 288, V34 is opened, and V31 and V33 are closed. Chamber 250 and lines 282 and 276 are then drained through line 294. Chamber 250 is rotated to the RETRIEVE position. The pig is driven by operating fluid through the tube 270 to junction 279 where it trips sensor 289 and V32 and V35 open to allow the pig to enter chamber 250. V32 and V35 are then closed, and the bleed line 298 and chamber 250 may be drained through line 294. The pig may then be returned to the LAUNCH position to continue the cleaning cycle as required, or returned to the ACCESS position for retrieval.

The method of the invention may also be used to clean tubing used in other chemical processes, such as heat exchangers, while the tubing is being used to convey fluids.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A method of cleaning tubing, in which the tubing has an inlet and an outlet, the method comprising the step of running a mesh pig defining a circumference having a scraping action through the tubing from the inlet to the outlet, wherein the scraping action is caused by longitudinal edges of circumferentially oriented portion of one or more wires in the outer periphery of the pig.

2. The method of claim 1 in which the tubing is tubing in a heater and the step of running the pig through the tubing is carried out repeatedly.

3. The method of claim 1 in which the tubing is tubing in a heater, the method further comprising:

returning the mesh pig to the inlet along return tubing in parallel connection to the heater tubing.

4. The method of claim 3 in which the method is carried out while the heater is in operation.

5. The method of claim 4 in which the mesh pig is run through the heater tubing after contaminant has formed on the inside of the heater tubing but before the contaminant has hardened.

6. The method of claim 3 further comprising, before the mesh pig is run through the heater tubing while the heater is in operation, thoroughly cleaning the heater tubing with a pig having a robust scraping action.

7. The method of claim 6 in which the pig having a robust scraping action is a ploymer pig with metallic scraping elements embedded in the polymer pig.

8. The method of claim 1 in which the mesh pig is made entirely of metal.

9. The method of claim 1 in which the mesh pig is tubular.

10. The method of claim 1 in which the mesh pig is made of a knitted wire.

11. The method of claim 1 in which the mesh pig is made of woven wire.

12. The method of claim 1 in which the mesh pig is radially expandable and is run through a first section of the tubing having a first diameter and a second section of the tubing having a second diameter, with the second diameter larger than the first diameter, and the mesh pig fits compressed within both the first section and the second section.

13. The method of claim 1 in which the one or more wires have a polygonal cross-section.

14. The method of claim 13 in which the one or more wires have a square cross-section.

15. The method of claim 1 in which the mesh pig is hollow.

16. The method of claim 1 in which the mesh pig is made of a metal mesh wrapped around itself.

* * * * *

UNITED STATES PATENT AND TRADEMARK OFFICE

CERTIFICATE OF CORRECTION

PATENT NO. : 6,569,255 B2
DATED : May 27, 2003
INVENTOR(S) : O. Sivacoe

It is certified that error appears in the above-identified patent and that said Letters Patent is hereby corrected as shown below:

Column 12,
Line 22, "oriented portion" should read -- oriented portions --
Line 23, "wires in" should read -- wires on --

Signed and Sealed this

Seventh Day of October, 2003

JAMES E. ROGAN
*Director of the United States Patent and Trademark Office*